US009754756B2

(12) United States Patent
Patti et al.

(10) Patent No.: US 9,754,756 B2
(45) Date of Patent: Sep. 5, 2017

(54) VACUUM INTEGRATED ELECTRONIC DEVICE AND MANUFACTURING PROCESS THEREOF

(71) Applicants: STMICROELECTRONICS S.R.L., Agrate Brianza (IT); STMICROELECTRONICS PTE LTD, Singapore (SG)

(72) Inventors: Davide Giuseppe Patti, Mascalucia (IT); Myung Sung Kim, Singapore (SG)

(73) Assignees: STMicroelectronics S.r.l., Agrate Brianza (IT); STMicroelectronics Pte Ltd, Singapore (SG)

( * ) Notice: Subject to any disclaimer, the term of this patent is extended or adjusted under 35 U.S.C. 154(b) by 0 days.

(21) Appl. No.: 15/150,895

(22) Filed: May 10, 2016

(65) Prior Publication Data

US 2017/0148604 A1 May 25, 2017

(30) Foreign Application Priority Data

Nov. 23, 2015 (IT) ..... 102015000075586

(51) Int. Cl.

| | |
|---|---|
| ***H01J 1/02*** | (2006.01) |
| ***H01J 19/02*** | (2006.01) |
| ***H01J 9/18*** | (2006.01) |
| ***H01J 21/20*** | (2006.01) |
| ***H01J 21/04*** | (2006.01) |

(52) U.S. Cl.

CPC ..... *H01J 19/02* (2013.01); *H01J 9/18* (2013.01); *H01J 21/04* (2013.01); *H01J 21/20* (2013.01); *H01J 2209/012* (2013.01); *H01J 2209/02* (2013.01)

(58) Field of Classification Search

CPC .... H01J 19/02; H01J 9/18; H01J 21/04; H01J 21/20; H01J 2209/02; H01J 2209/012

See application file for complete search history.

(56) References Cited

U.S. PATENT DOCUMENTS

| | | | | |
|---|---|---|---|---|
| 5,140,219 | A | 8/1992 | Kane | |
| 5,463,269 | A | 10/1995 | Zimmerman | |
| 6,023,126 | A * | 2/2000 | Karpov | H01J 1/3042 313/309 |
| 2001/0006842 | A1 * | 7/2001 | Hattori | H01J 9/025 438/584 |

(Continued)

FOREIGN PATENT DOCUMENTS

RU 2332745 C1 8/2008

OTHER PUBLICATIONS

Pennisi, S. et al., "Dovetail Tip: A new Approach for Low-Threshold Vacuum Nanoelectronics," IEEE Transactions on Electron Devices 62(12):4293-4300, Dec. 2015.

*Primary Examiner* — Donald Raleigh
(74) *Attorney, Agent, or Firm* — Seed IP Law Group LLP

(57) ABSTRACT

A vacuum integrated electronic device has an anode region of conductive material; an insulating region on top of the anode region; a cavity extending through the insulating region and having a sidewall; and a cathode region. The cathode region has a tip portion extending peripherally within the cavity, adjacent to the sidewall of the cavity. The cathode region is formed by tilted deposition, carried out at an angle of 30-60° with respect to a perpendicular to the surface of device.

20 Claims, 6 Drawing Sheets

(56) References Cited

U.S. PATENT DOCUMENTS

2011/0305314 A1* 12/2011 Kitamura ..... H01J 1/3044
378/62

2014/0353576 A1 12/2014 Patti

* cited by examiner

VACUUM INTEGRATED ELECTRONIC DEVICE AND MANUFACTURING PROCESS THEREOF

BACKGROUND

Technical Field

The present disclosure relates to an improved vacuum integrated electronic device and the manufacturing process thereof.

Description of the Related Art

As is known, the idea of miniaturized vacuum integrated electronic devices dates back to 1961. However, the increasing demand for high-speed high-power telecommunication systems has recently given a new impulse to the research in the field of vacuum micro- and nanoelectronics because of their good characteristics in handling high voltages and high powers.

Therefore, the availability of a device merging the above advantages with those of the solid-state technology would open new potential scenarios of future markets and products for long-range telecommunications, aerospace and medical systems.

Unfortunately, manufacturing such devices has proven to be difficult, in particular as regards the shape and surface composition of the cathode. Specifically, techniques to concentrate the electric field with sufficient intensity to produce emission with practical turn-on voltages have been studied and materials with low-work function, good chemical, thermal, mechanical and electrical properties have been investigated. These materials must also be suitable for the implementation of tips with small radius and high aspect ratio (the ratio between the base diameter and the tip height).

Generally, these structures have conical or pyramidal metal micro-tip cathodes.

For example, FIG. 1 shows the structure of a triode having a conical tip. The triode of FIG. 1 comprises first, second and third metal layers 2, 3, 4, separated by dielectric layers 5, 6, deposited on a glass substrate 1. The first metal layer 2 extends on the glass substrate 1 and forms a cathode; the second metal layer 3 extends between the first and the third metal layers 2, 4 and forms a gate and the third metal layer 4 forms an anode. A cavity 8 is formed in the dielectric layers 5, 6 and in the second metal layer 3 and houses a tip 9, extending from the first metal layer 2 toward the second metal layer 3.

Here, emission is caused by the gate-cathode voltage and emitted electrons are collected by the anode 4.

This solution is quite complex to be manufactured.

Another known solution is a lateral structure, which can be fabricated in a planar way, as shown in FIG. 2. Here, an anode region 10, a cathode region 11 and two gate regions 12 are formed in a single metal layer and are shaped to obtain a controlled emission of electrons. The lateral structure offers a simpler fabrication process and easy shaping of electrodes through lithography, but at the expense of large area occupation and reduced current density.

In another possible structure, shown in FIG. 3, electron emission does not originate from a small tip region but, rather, from a peripheral edge 14 of a thin metal cathode region 20, that is holed. An anode region 21 and a gate region 22 are similar to those in FIG. 1. The main drawback of this solution is the high area occupation.

In an alternative structure, disclosed in U.S. Pat. No. 5,463,269, a vacuum integrated microelectronic device is manufactured by conformal deposition of an insulating material in a cavity, thus forming a symmetrical cusp that can be used as a mold to form a micro-tip cathode. Two electrodes form a simple diode, while three, four or five electrodes can form, respectively, a triode, a tetrode and a pentode. Since the cusp is self-aligned to the center of the cavity, it is also aligned to the center of the electrodes. However, the manufacture of the above vacuum integrated microelectronic device has high manufacturing costs and its operating characteristics can be altered by, for instance, ionizing radiations and noise at power output.

MI2013A000897 (US 2014/0353576) describes an electron emitting device wherein the cathode is formed by depositing a metal layer on a dielectric layer having a cavity. During deposition, the metal material forms horizontal portions that protrude over the cavity and joins to form a tip. The width of the cavity is such that the metal layer does not fall into the cavity, which is thus sealed by the metal layer.

Although this solution has proved satisfactory in many situations, it cannot be used in all applications and devices. In fact, the voltage causing turning on of the electron emission is quite high, e.g., up to 20V, which is too high for some electronic application. In addition, this voltage is far from common threshold voltage of components integrated in VLSI/ULSI technology. Thus, a better compatibility with voltages used in common semiconductor voltages is desired.

Thus, an aim of the disclosure is to provide an improved vacuum integrated electronic device.

BRIEF SUMMARY

According to the present disclosure, there are provided a vacuum integrated electronic device and the manufacturing process thereof, as defined in claims 1 and 10, respectively.

BRIEF DESCRIPTION OF THE SEVERAL VIEWS OF THE DRAWINGS

For the understanding of the present disclosure, preferred embodiments are now described, purely as a non-limitative example, with reference to the enclosed drawings, wherein.

DETAILED DESCRIPTION

Figure 1:
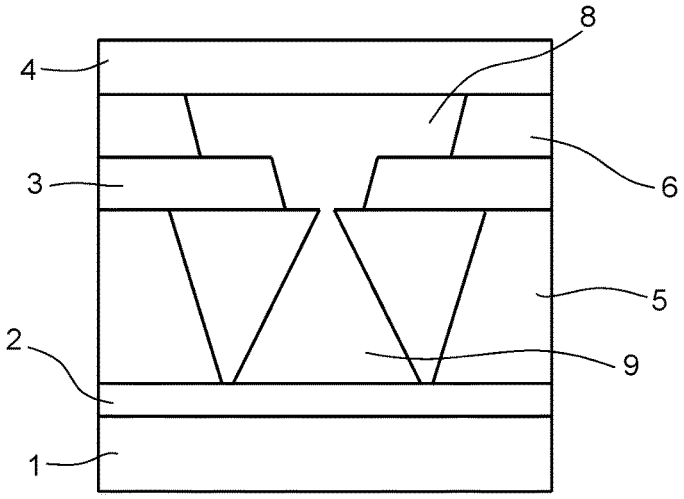
Fig.1 (Prior Art)
FIG. 1 is a cross-section of a vacuum micro-triode structure.
Figure 2:
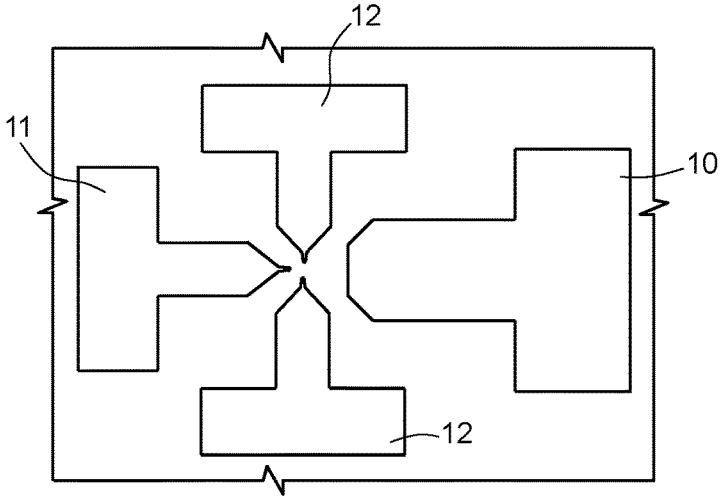
Fig.2 (Prior Art)
FIG. 2 is a top view of an alternative vacuum micro-triode structure.
Figure 3:
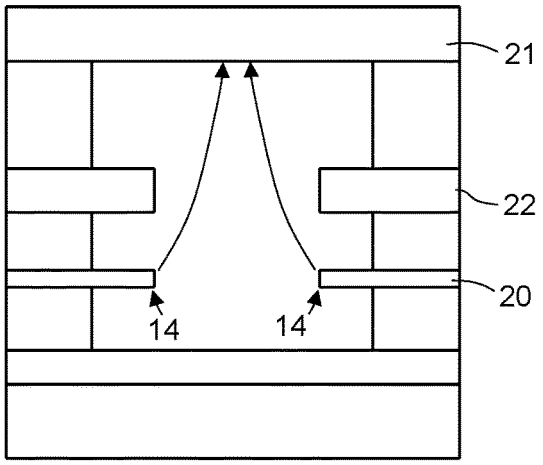
Fig.3 (Prior Art)
FIG. 3 is cross-section of another alternative vacuum micro-triode structure.
Figure 4:
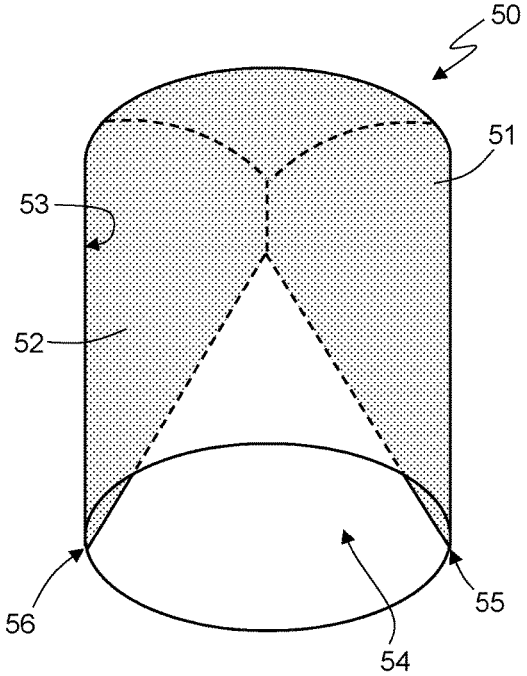
FIG. 4 is a perspective schematic cross-section of the present electron emitting structure.

FIG. 4 schematically shows an electron emitting structure or cathode 50 comprising a tip portion implemented as a first and a second half-cone 51, 52. The half-cones 51, 52 are formed on internal sidewalls 53 of a cavity 54 having a cylindrical shape, as also shown in the bottom view of FIG. 5. Therefore, the electron emitting structure 50 has a first and a second tip 55, 56 formed by the vertices of the half-cones 51, 52 and arranged adjacent to the sidewalls 53 of the cavity 54.

The described emitting structure 50 is able to generate an electric field that is considerably increased with respect to known solutions by virtue of the very sharp conical shape of the two tips 55, 56.

In fact, significant emission of electrons from metals occurs when the surface electric field is in the range of approximately $2\times10^7$ $Vcm^{-1}$. The surface electric field is related to the applied gate voltage and to a field enhancement factor. The enhancement factor depends on the geometry of the electron emitter and is inversely proportional to the radius of the electron emitter tip. Therefore, the sharper the tip is, the greater the electric field is.

Figure 5:
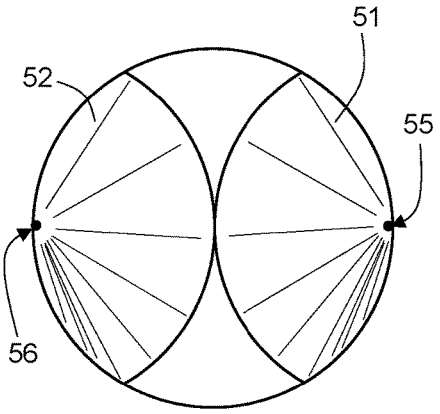
FIG. 5 is a bottom view of the electron emitting structure of FIG. 4.

The electron emitting structure 50 of FIGS. 4 and 5 may be implemented through the following process steps, as described with reference to FIGS. 6A-6H.

Figure 6A:
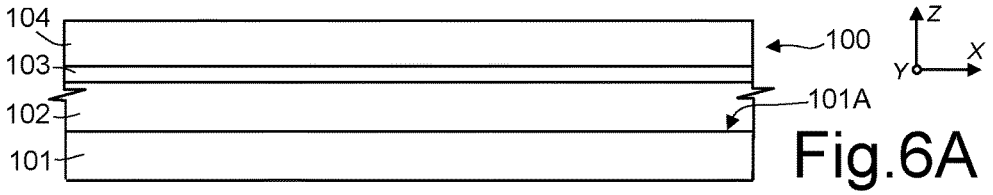
FIGS. 6A-6H are cross-sections of a semiconductor wafer in subsequent manufacturing steps of the electron emitting device of FIG. 4.

FIG. 6A shows a wafer 100 including a substrate 101, e.g., a highly-doped N-type silicon, having a planar surface 101A. A first insulating layer 102, e.g., of silicon oxide, is grown or deposited on the surface 101A of the substrate 101. The thickness of first insulating layer 102 is such that it can withstand the voltage between a gate electrode (see below) and the silicon substrate 101. For example, the thickness of first insulating layer 102 may be comprised between 300 and 1500 nm, for a diameter of cavity 54 comprised between 200 and 600 nm.

Then, a conductive layer 103 is deposited on the first insulating layer 102. The conductive layer 103 is, e.g., a non-ferromagnetic metal, a highly doped polycrystalline silicon or another material with high conductivity, compatible with the manufacture of vacuum integrated microelectronic devices.

A second insulating layer 104, for example of silicon oxide, is then deposited on the conductive layer 103. The thickness of the second insulating layer 104 depends on the vertical length of the tip portions 51, 52 (FIG. 4) and may be, for example, of 300-900 nm, thus obtaining the structure of FIG. 6A.

Figure 6B:
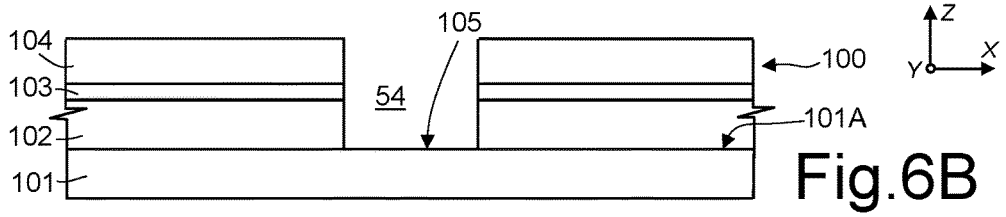

Then, FIG. 6B, the cavity 54, having the sidewalls 53 and a bottom 105, is formed by lithographic techniques, using a selective anisotropic etching. As indicated, the cavity 54 is cylindrical with a circular section and extends down to the silicon substrate 101.

Figure 6C:
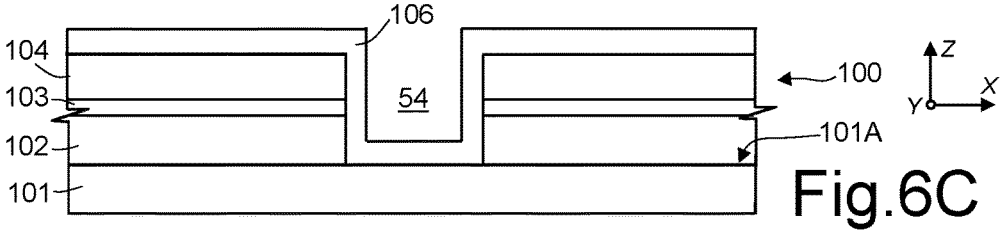

Thereafter, FIG. 6C, an insulating material 106, e.g., of silicon nitride, is conformally deposited on the second insulating layer 104, the sidewalls 53 and the bottom 105 of the cavity 54. The thickness of the insulating material 106 may be 20-100 nm.

Figure 6D:
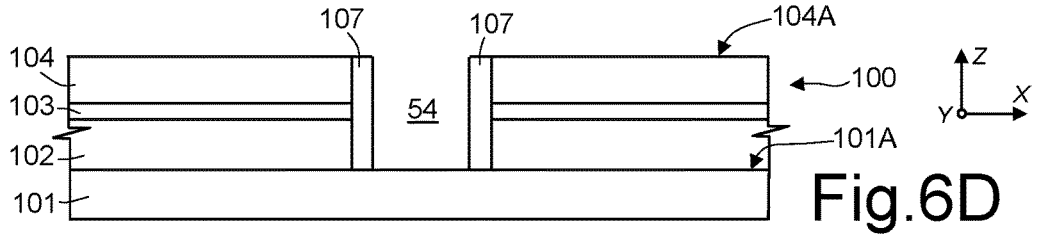

Then, FIG. 6D, portions of the insulating layer 106 that cover the bottom 105 of the cavity 54 and an upper surface 104A of the second insulating layer 104 are selectively removed by anisotropic etching, so to leave only a portion covering the sidewalls 53 of the cavity 54, forming a vertical insulating layer 107.

Subsequently, FIG. 6E, the first half-cone 51 is formed inside the cavity 54 using a metal deposition method, such as evaporation, sputtering or CVD. The deposition is carried out under vacuum in a tilted way, causing atoms of a metal element, such as titanium, to impact on the second insulating layer 104 and the vertical insulating layer 107 with an angle of 30-60° with respect to a vertical plane perpendicular to the surface 101A of the substrate 101 (parallel to plane YZ of FIG. 6E). For example the deposition is carried out at a pressure of $10^{-7}$-$10^{-5}$ Torr. Thereby, the first half-cone 51 grows in the cavity 54 on the vertical insulating layer 107 (see also the bottom view of FIG. 7A), with the first tip 55 pointing towards the surface 101A of the substrate 101. Simultaneously, a metal layer 108 grows on the second insulating layer 104 and accumulates on the upper edge of the cavity 54. At the end of the first deposition step, the metal layer 108 may have a thickness comprised between one half and two thirds of the cavity diameter (e.g., 100-400 nm).

Figure 6E:
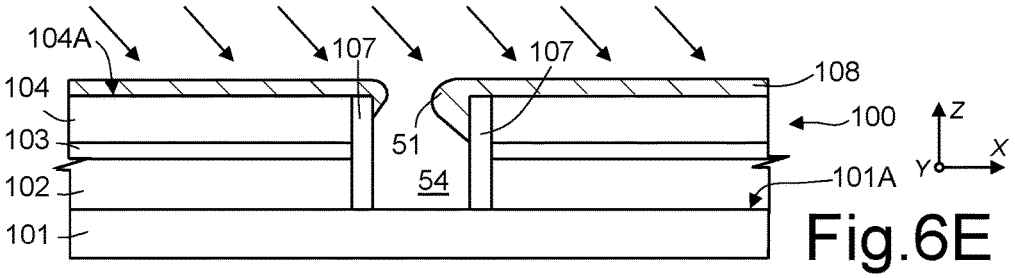
Figure 6F:
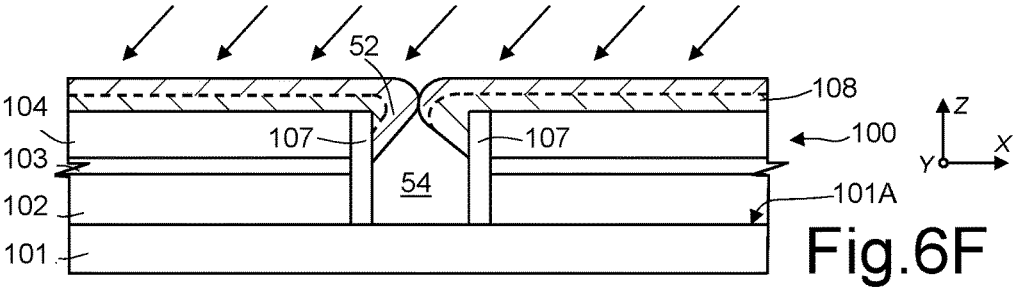
Figure 6G:
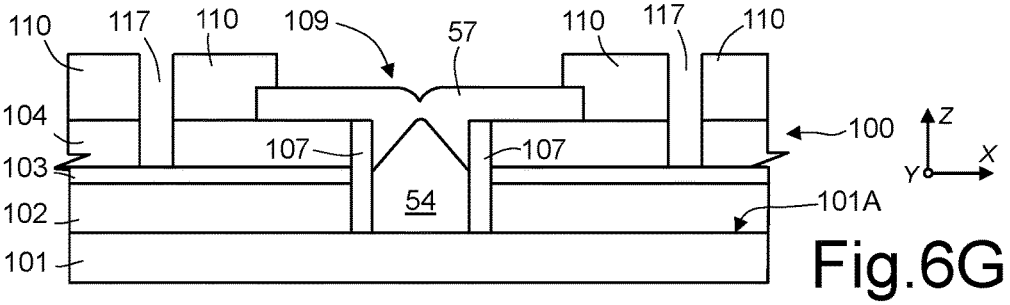
Figure 7A:
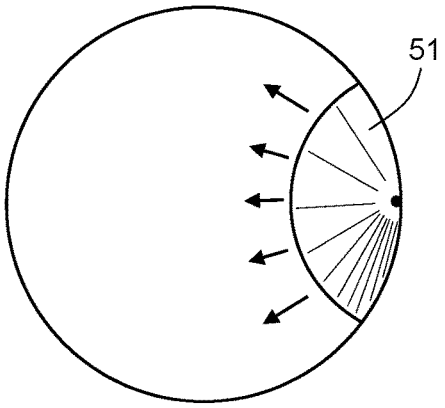
FIGS. 7A and 7B are bottom views of the electron emitting device of FIG. 4 in intermediate manufacturing steps.
Figure 7B:
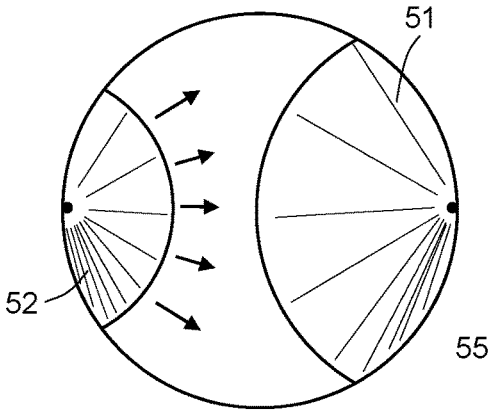

Thereafter, FIG. 6F, the second half-cone 52 is formed inside the cavity 54 by a deposition step carried out with an impact angle of metal atoms symmetrical to that of FIG. 6E (that is to plane YZ of FIG. 6F). All the other parameters may be the same. As a result, the second half-cone 52 is formed on the vertical insulating layer 107, in front of the first half-cone 51, as shown in FIG. 7B. Therefore, the second tip 56 is formed, pointing towards the surface 101A of the substrate 101 and arranged roughly diametrically opposite the first tip 55.

Simultaneously with the formation of the second half-cone 52, the metal layer 108 grows both vertically and horizontally, from the upper edge of the cavity 54, until it closes and seals the latter. Therefore, the vacuum is retained inside the cavity 54 as a side effect of the deposition. Deposition is continued until the metal layer 108 reaches a thickness up to 500 nm. Then, FIG. 6G, the metal layer 108 is defined to form a closing portion 57; an upper insulating layer (e.g., silicon oxide) 110 is deposited; and apertures 117 are formed in the upper insulating layer 110 and in the second insulating layer 104, down to the conductive layer 103.

Thereby, the closure portion 57 and the half cones 51, 52 are integral to each other and form a cathode 109.

Figure 6H:
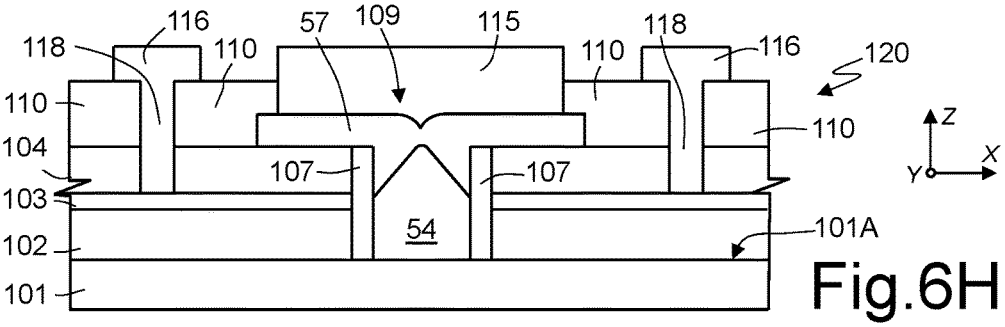
Figure 8:
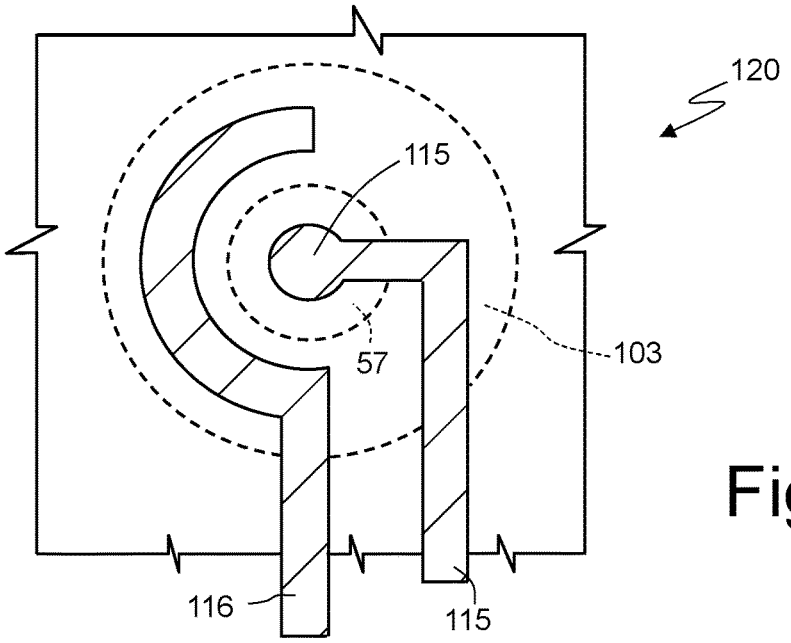
FIG. 8 is a top view of the electron emitting device of FIG. 4.

Thereafter, FIG. 6H, an aluminum layer, acting as a contact metal layer, is deposited on the metal layer 108 and in the apertures 117, forming metal plugs 118. In the alternative, when a very small contact area is desired, the apertures may be filled by another material, for example depositing, e.g., tungsten. In this case, an "etch-back" step is then carried out in order to remove the tungsten outside the metal plugs 118. The aluminum layer is then defined, to form a cathode contact 115 electrically coupled to the cathode 109 and a gate contact 116 electrically coupled to the metal plugs 118 as shown in FIG. 8. In addition, an anode contact structure is formed under the substrate 101, in a known manner, not shown.

After dicing, an electron emitting vacuum triode 120 is obtained.

The described electron emitting vacuum triode 120 is able to generate a considerably increased electric field with respect to known solutions, as explained above.

Simulations by the Applicant have shown that the described electron emitting vacuum diode 120 has a turn-on voltage of about 2 V. Such value is very suitable for high-power switching applications and is much lower than with prior devices with even smaller tip radius and gate aperture.

The described electron emitting vacuum diode 120 is also advantageous due to the self-alignment of the structures and compatibility with IC technologies. In addition, the described structure is very compact, since the metal layer 108 forms both the cathode and the cathode electrode. This realization of the cathode and the cathode electrode through a single metal layer allows a high integration density to be achieved. The electron emitting vacuum diode 120 further has a low-threshold.

Figure 9:
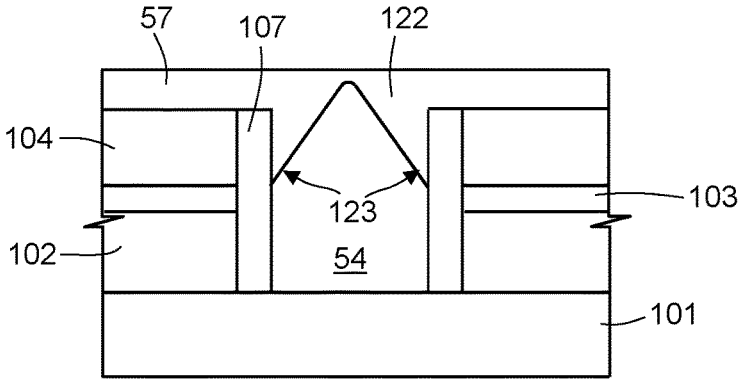
FIG. 9 a cross-sectional view of a different embodiment of the present electron emitting device.

In another embodiment of the present vacuum electron emitting device, the tip portion is formed as a single electron emitting structure 122 extending substantially on the whole circumferential surface of the sidewalls 53 of the cavity 54, as shown in FIG. 9.

The single electron emitting structure 122 may be formed, e.g., during a single deposition step by rotating the wafer 100 around its axis, thus causing metal atoms, for example titanium, to impact on the whole periphery of the cavity 54. All the other parameters may be the same as above discussed.

Thereby, the electron emitting structure 122 has a circumferential tip 123 pointing towards the bottom of the cavity 54. Also here, the closing portion 57 extends over the upper edge of the cavity 54, and seals it, analogously to the embodiment of FIG. 6H.

The present vacuum integrated electronic device may also be implemented as a diode, a tetrode or a pentode.

Figure 10:
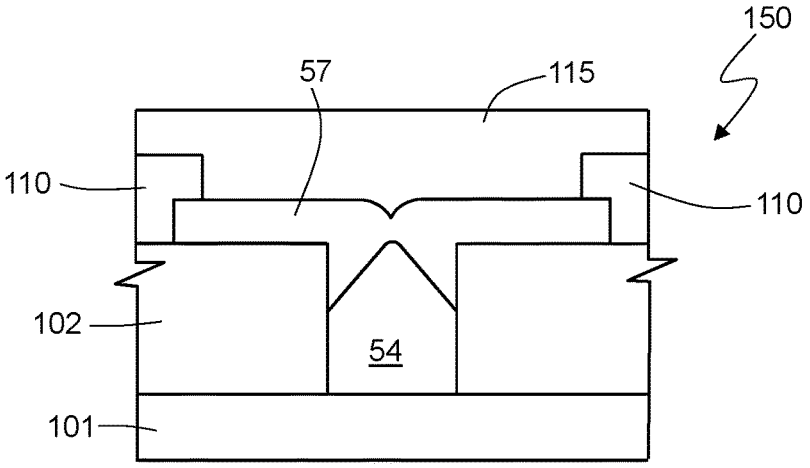
FIG. 10 shows a cross-section view of another embodiment of the present electron emitting device.

For example, FIG. 10 shows a diode 150. Here, the cavity 54 extends through the first insulating layer 102 only.

Figure 11:
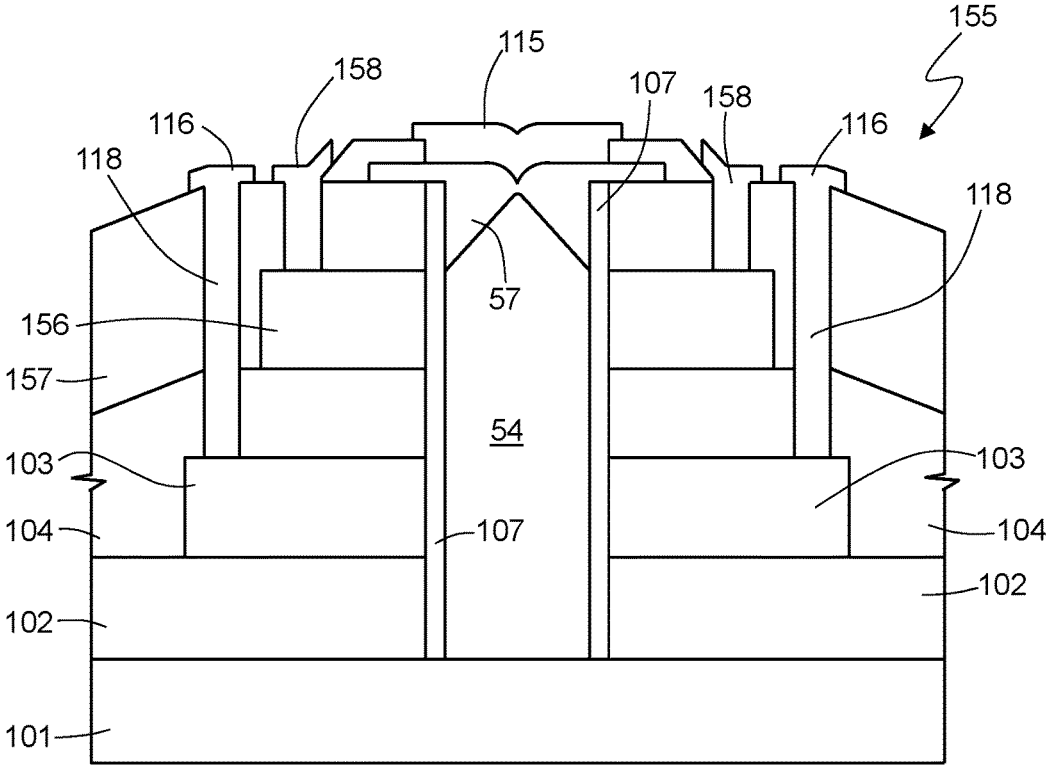
FIG. 11 shows a cross-section view of yet another embodiment of the present electron emitting device.
Figure 12:
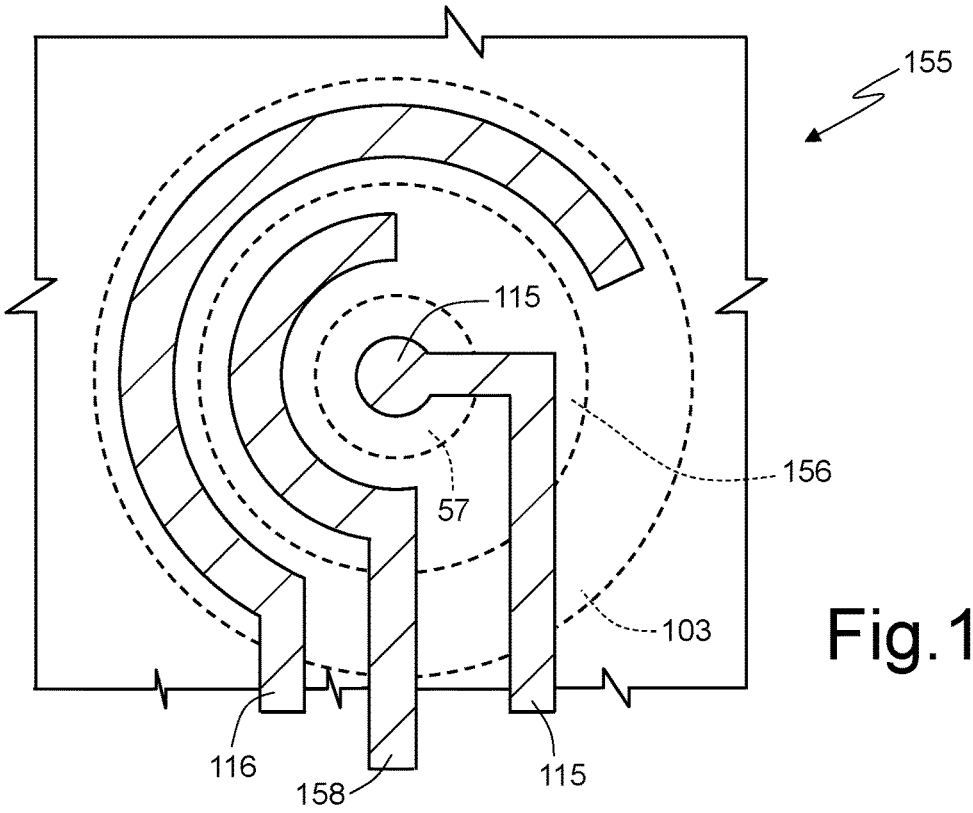
FIG. 12 is a top view of the electron emitting device of FIG. 11.

FIG. 11 shows a tetrode 155. Here, a second conductive layer 156 is deposited on the second insulating layer 104 and, thereon, a third insulating layer 157 is deposited. Furthermore, first metal plugs 118 connect the first conductive layer 103 and second metal plugs 158 connect the second conductive layer 156 to the surface of the tetrode 155. FIG. 12 shows the structure of the contacts to the conducting parts of the tetrode 155.

Figure 13:
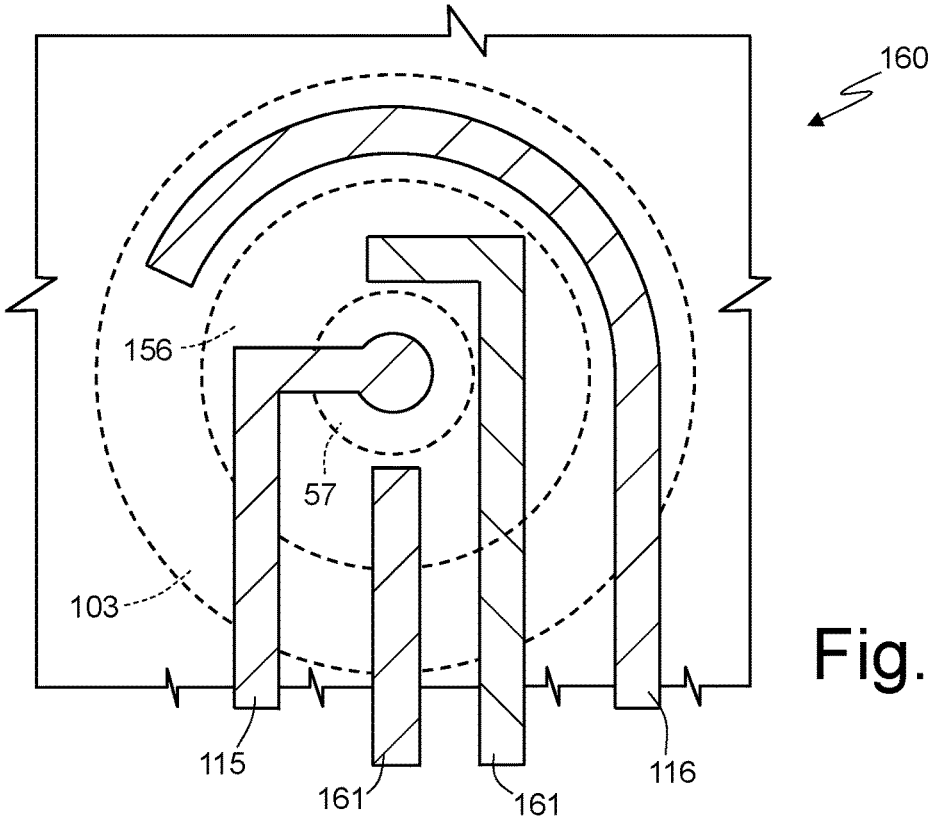
FIG. 13 is a top view of a different embodiment of the present electron emitting device.

FIG. 13 shows the contact structure of a vacuum integrated electronic device implemented as a hot triode 160. The hot triode 160 has the same cross-section of the tetrode 155 of FIG. 11. Here, metal paths 161 are formed to couple the second conductive layer 115 to a metal heater (not shown). The metal paths 161 contact the conductive layer 103 in opposite portions. By suitably biasing the metal paths 161, a current flows through the conductive layer 104 which, acting as a resistor, heats.

All the above embodiments share the advantages described above, and have an increase electric field generated by the tips 55, 56 or the circumferential tip 123.

Finally, it is clear that numerous variations and modifications may be made to the device described and illustrated herein, all falling within the scope of the disclosure.

For example, the vacuum integrated electronic device may also be a pentode, by adding another insulating layer and another conductive layer and relevant contacts.

The tip portion of the vacuum integrated electronic device could be of a different material, such as molybdenum zinc, strontium, cerium, neodymium.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A vacuum integrated electronic device comprising:
- an anode region of conductive material;
- an insulating region on top of the anode region;
- a cavity extending through the insulating region and having a sidewall, the sidewall having an inner surface; and
- a cathode region having a tip portion extending peripherally within the cavity, the tip portion being on the inner surface of the sidewall of the cavity.

2. The device according to claim 1, wherein the cathode region is a metal layer including a closing portion integral to the tip portion, the closing portion extending on top of the insulating region and closing the cavity, the tip portion extending in the cavity from the closing portion.

3. The device according to claim 1, wherein the tip portion has a triangular cross-section with a vertex pointing towards the anode region.

4. The device according to claim 1, wherein the tip portion comprises a plurality of tip ends having each a generally half-conical shape and a tip pointing towards the anode region.

5. The device according to claim 4, wherein the tip portion has only two tip ends.

6. The device to claim 1, wherein the tip portion extends circumferentially along the sidewall of the cavity and has a single tip end.

7. The device according to claim 1, wherein the insulating region comprises a plurality of insulating layers and at least one conductive layer separating the insulating layers from each other; the device further comprising a side insulating layer extending on the sidewall of the cavity between the insulating region and the tip portion.

8. The device according to claim 1, wherein the device is a triode and the insulating region includes first and second insulating layers and a conductive gate layer positioned between the first and second insulating layer, the cavity extending through the first and second insulating layers and the conductive gate layer.

9. A process for manufacturing a vacuum integrated electronic device, comprising:
- forming an insulating region on top of an anode region of conductive material;
- forming a cavity through the insulating region, the cavity having a sidewall with an inner surface; and
- forming a cathode region having a tip portion extending peripherally within the cavity, the tip portion being on the inner surface of the sidewall.

10. The process according to claim 9, wherein forming the cathode region comprises depositing a metal layer on the insulating region and in the cavity using a tilted deposition to grow the tip portion on the sidewalls of the cavity and a closing portion on top of the insulating region closing the cavity.

11. The process according to claim 10, wherein depositing the metal layer comprises growing a first tip element on a first side of the sidewall of the cavity and thereafter growing a second tip element on a second side of the sidewall of the cavity, opposite the first side.

12. The process according to claim 11, wherein the first and second tip elements each have a half-cone shape.

13. The process according to claim 10, wherein depositing a metal layer comprises growing a peripheral tip element having a single tip end extending circumferentially along the sidewall of the cavity.

14. The process according to claim 10, wherein the anode region has a surface and the tilted deposition is carried out at an angle of 30-60° with respect to an axis perpendicular to a surface of the anode region.

15. The process according to claim 10, wherein depositing the metal layer comprises depositing a material selected from titanium, molybdenum, zinc, strontium, cerium, neodymium.

16. The process according to claim 10, wherein forming the cathode region includes depositing metal atoms by evaporation, sputtering or chemical vapor deposition.

17. A vacuum integrated electronic device comprising:

an anode region of conductive material;

a cathode region;

an insulating region positioned between the anode and cathode regions; and a cavity extending through the insulating region and having a sidewall, wherein the cathode region has a tip portion extending into the cavity and to the sidewall of the cavity, the insulating region comprising a plurality of insulating layers and at least one conductive layer separating the insulating layers from each other, the device further comprising a side insulating layer extending on the sidewall of the cavity between the insulating region and the tip portion.

18. The device according to claim 17, wherein the cathode region is a metal layer including a closing portion integral to the tip portion, the closing portion extending on top of the insulating region and closing the cavity, the tip portion extending in the cavity from the closing portion.

19. The device according to claim 17, wherein the tip portion has a triangular cross-section with a vertex pointing towards the anode region.

20. The device according to claim 17, wherein the sidewall has an inner surface and the tip portion of the cathode region is on the inner surface of the sidewall.

* * * * *